United States Patent [19]

Osika et al.

[11] Patent Number: 5,047,598

[45] **Date of Patent: * Sep. 10, 1991**

[54] SAFETY ROCKER WITH IMPROVED ACTUATOR MOUNTING

[75] Inventors: Thomas F. Osika, Valparaiso; John A. Stuhlmacher, Crown Point, both of Ind.

[73] Assignee: McGill Manufacturing Company, Inc., Valparaiso, Ind.

[ * ] Notice: The portion of the term of this patent subsequent to Sep. 26, 2006 has been disclaimed.

[21] Appl. No.: 402,907

[22] Filed: Sep. 1, 1989

Related U.S. Application Data

[63] Continuation-in-part of Ser. No. 114,129, Oct. 28, 1987, Pat. No. 4,870,230.

[51] Int. Cl.[5] ..... H01H 3/20

[52] U.S. Cl. ..... 200/43.16; 200/322

[58] Field of Search ..... 200/43.16, 43.17, 43.01, 200/321, 322, 339, 433

[56] References Cited

U.S. PATENT DOCUMENTS

| | | | |
|---|---|---|---|
| 3,165,604 | 1/1965 | Sorenson | 200/437 |
| 4,187,420 | 2/1980 | Piber | 200/43.16 |
| 4,870,230 | 9/1987 | Osika et al. | 200/339 X |

*Primary Examiner*—Renee S. Luebke

*Attorney, Agent, or Firm*—Leydig, Voit & Mayer

[57] ABSTRACT

An electrical switch includes a rocker-type actuator adapted to be pivoted between first and second positions within a housing in order to close and open switch contacts. The actuator slidably supports a latch which normally engages the housing to prevent the actuator from being pivoted to its switch-closed position. By pulling on the latch and then lifting on the actuator, the actuator may be pivoted to its switch-closed position; the two-step operation protecting against accidental actuation of the switch. The actuator may be returned to its switch-open position by a simple single motion thereby enabling rapid opening of the switch under emergency conditions. A high strength rivet supports the actuator for pivoting within the housing and also supports the latch to pivot with and to slide relative to the actuator.

3 Claims, 2 Drawing Sheets

SAFETY ROCKER WITH IMPROVED ACTUATOR MOUNTING

CROSS-REFERENCE TO A RELATED APPLICATION

This application is a continuation-in-part of our copending application Ser. No. 114,129, filed Oct. 28, 1987, now U.S. Pat. No. 4,870,230.

BACKGROUND OF THE INVENTION

This invention relates generally to a switch and, more particularly, to a switch of the type having a pivotally mounted rocker actuator. When the rocker is pivoted between first and second positions, it changes the state of the switch contacts.

With certain types of equipment such as power tools, power take-off attachments for tractors, and other equipment which might possibly cause injury, it is desirable to protect the switch against accidental actuation. While certain safety switches have been designed to guard against accidental actuation, such switches are relatively complex and expensive and, in some instances, can still be actuated accidentally in spite of the measures which are taken to ostensibly prevent such actuation.

Our copending application identified above discloses a rocker switch which is of comparatively simple and low cost construction and which effectively guards against accidental actuation in that the switch can be thrown to an actuated condition only if two separate and distinct motions are applied to the switch. Specifically, the switch includes a body having a switch contact, a switch actuator which is supported by the body to pivot between first and second positions to change the state of the switch contact, and a latch which is supported both to pivot with the actuator and to slide relative to the actuator. Only by first sliding the latch relative to the actuator and to an unlatched position can the actuator be pivoted relative to the body to change the state of the switch contact to an actuated condition.

SUMMARY OF THE INVENTION

The general aim of the present invention is to provide a new and improved safety switch of the foregoing type in which the switch actuator and the latch are supported on the body with a higher strength mounting than has been the case heretofore.

A more detailed object of the invention is to achieve the foregoing by utilizing a high strength rivet to support the actuator for pivoting relative to the body and to support the latch for pivoting with and sliding relative to the actuator.

The invention also resides in the provision of a simplified switch contact which both slides and pivots within the body when the position of the switch actuator is changed.

These and other objects and advantages of the invention will become more apparent from the following detailed description when taken in conjunction with the accompanying drawings.

DETAILED DESCRIPTION OF THE PREFERRED EMBODIMENT

Figure 1:
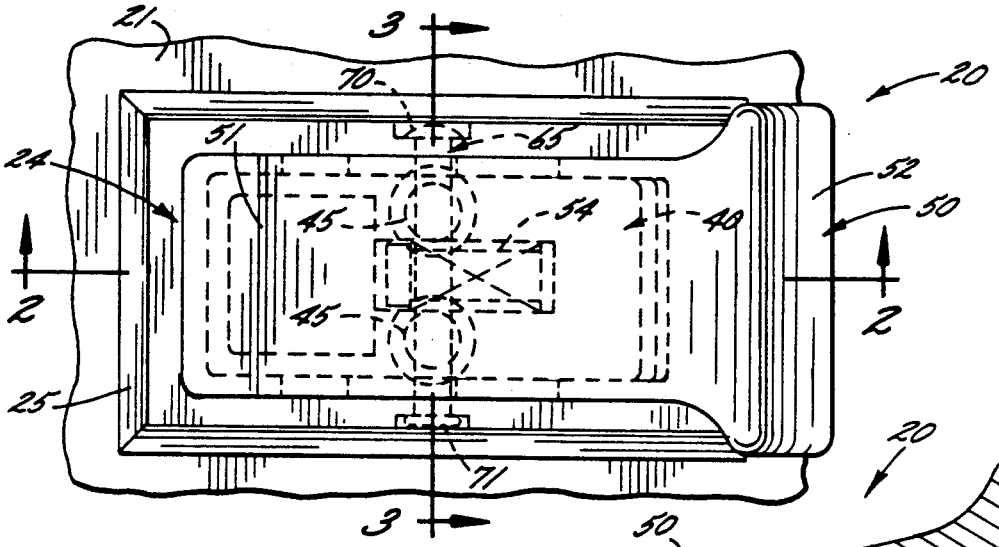
FIG. 1 is a top plan view of a new and improved safety switch incorporating the unique features of the present invention.

For purposes of illustration, the present invention has been shown in the drawings as being incorporated in an electrical switch 20 for making or breaking circuits to one or more electrical utilization devices (not shown). By way of example, one utilization device may be a solenoid which, when energized, causes the power take-off of a tractor to engage. The switch may be used solely with the solenoid or may be used both with the solenoid and with another electrical utilization device whose operation is interrupted when the solenoid is energized.

Figure 6:
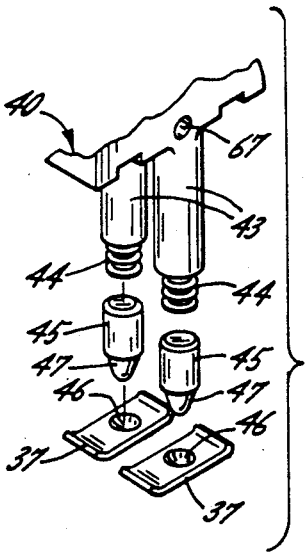
FIG. 6 is an exploded perspective view of other components of the switch.

In the present instance, the switch 20 has been shown in conjunction with a mounting plate 21 which is formed with a rectangular hole 22 for receiving the switch. The switch includes a main body or housing 23 (FIG. 2) which is partially defined by a molded plastic sleeve 24 of rectangular cross-section telescoped into the opening 22 and formed with a peripheral flange 25 which engages the upper side of the plate 21 around the margins of the opening. The sleeve includes two laterally spaced and opposing side walls 24A and two depending tangs 24B located at the ends of the side walls (see FIG. 6). Cantilevered fingers 26 are molded integrally with and are hinged to the tangs and are adapted to pass through the opening 22 during insertion of the sleeve into the opening. Just after such insertion, the fingers 26 spring outwardly and engage the lower portion of the edge of the opening 22 so as to hold the sleeve 24 in the opening.

The housing 23 also includes an upwardly opening cup 27 (FIG. 2) made of plastic and adapted to be telescoped into the lower end portion of the sleeve 24, the upper edge of the cup engaging a radially inwardly projecting flange 28 formed integrally with the sleeve about midway along the height of the sleeve. Lips 29 on the lower ends of the tangs 24B engage the cup with a snap fit in order to hold the sleeve and the cup in assembled relation.

Located in the bottom of the cup 27 are two side-by-side sets of spaced electrical contacts 31 and 32 (FIG. 2) connected to terminals 33 and 34, respectively. Only one set of contacts 31 and 32 and one set of terminals 33 and 34 are visible in the drawings but it should be understood that the other set of contacts and the other set of terminals are disposed alongside those which have been illustrated.

Figure 2:
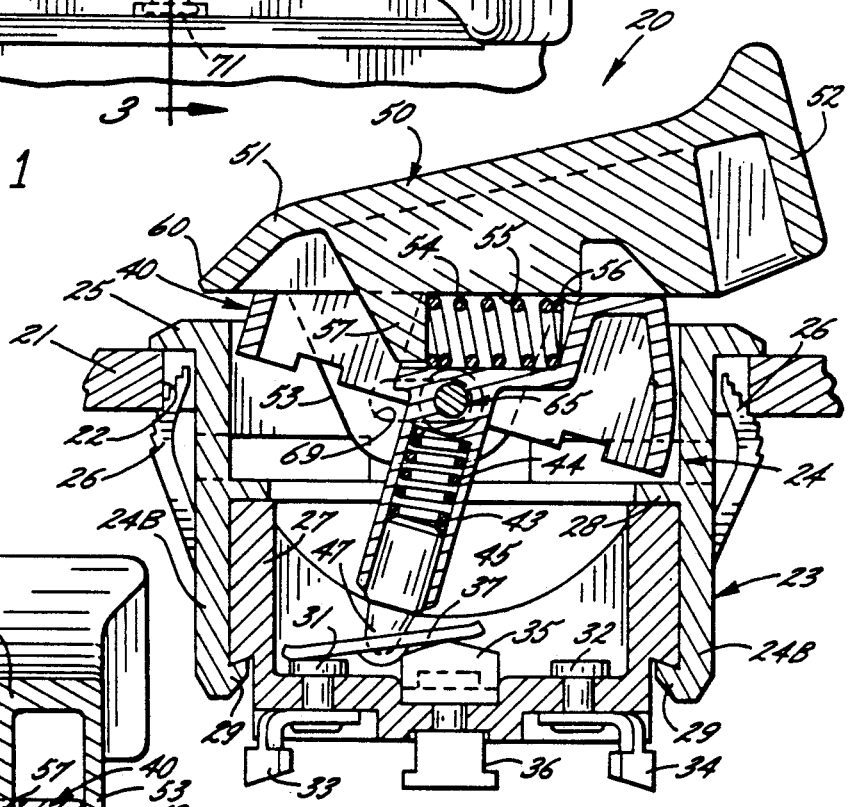
FIGS. 2 and 3 are fragmentary cross-sections taken substantially along the lines 2—2 and 3—3, respectively, of FIG. 1.

Positioned between the contacts 31 and 32 of each set is a generally V-shaped fulcrum 35 connected to a terminal 36. Advantageously, a switch contact 37 in the form of a metal strip is supported both to rock on and slide across each fulcrum. Normally, each contact 37 is positioned as shown in FIG. 2 in which the contact is rocked downwardly in one direction about the fulcrum 35 and bridges the fulcrum and the contact 31 to complete a circuit between the terminals 33 and 36 and energize a utilization device in the circuit. Upon being moved to the position shown in FIG. 4, the contact 37 first slides across the fulcrum 35 and then rocks downwardly in the opposite direction about the fulcrum. This causes the contact 37 to bridge the fulcrum 35 and the contact 32 so as to complete a different circuit and energize another utilization device such as the solenoid of a power take-off.

Figure 3:
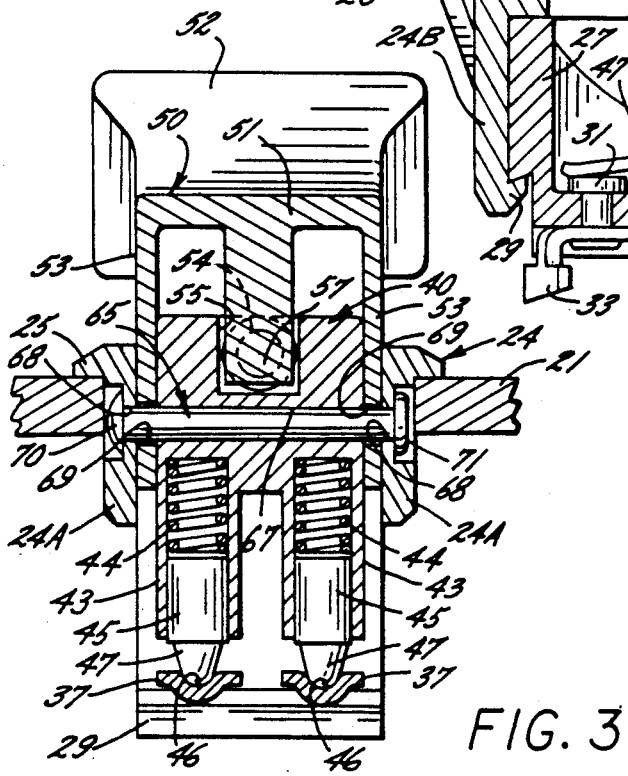
Figure 4:
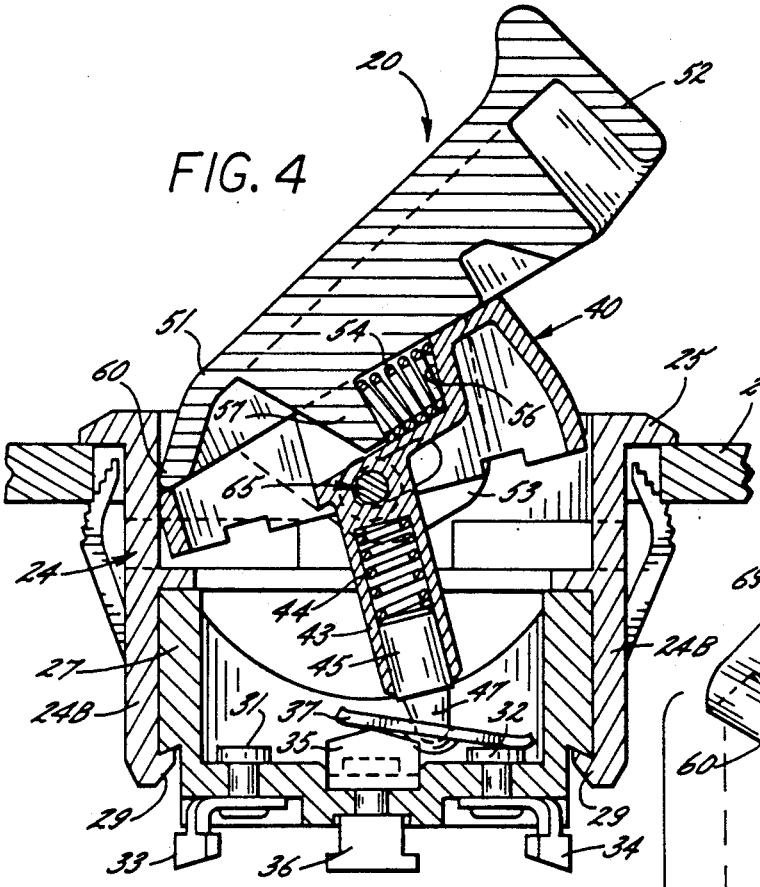
FIG. 4 is a view generally similar to FIG. 2 but shows certain components of the switch in moved positions.

Sliding and pivoting of the contacts 37 is effected by a rocker-type actuator 40 which is supported by the sleeve 24 of the housing 23 to pivot counterclockwise from a normal position (FIG. 2) to an actuated position (FIG. 4). Herein, the rocker 40 is molded of plastic and is formed with a pair of side-by-side and generally vertical sleeves 43 (FIGS. 3 and 6) which house springs 44 and plungers 45, the springs biasing the plungers downwardly against the contacts 37. The upper side of each contact 37 is formed with a hemispherical socket 46 (FIG. 6) which receives a rounded tip 47 of the plunger in order to enable the plunger to pivot relative to the contact.

When the rocker 40 is pivoted counterclockwise from the normal position shown in FIG. 2 to the actuated position shown in FIG. 4, the plungers 45 act through the sockets 46 to cause the contacts 37 to ride from left-to-right across the fulcrums 35. Once each plunger 45 crosses the center of the fulcrum, the spring 44 causes the plunger to pivot the contact 37 clockwise about the fulcrum in order to bring the contact into engagement with the contact 32. Each contact 37 slides from right-to-left and then pivots counterclockwise when the rocker 40 is returned from the actuated position of FIG. 4 to the normal position of FIG. 2. The springs 44 tend to urge the rocker clockwise toward the normal position shown in FIG. 2 as the plungers cross from right-to-left over the centers of the fulcrums 35.

The switch 20 is provided with a latch 50 which prevents the switch rocker 40 from being moved to its actuated position of FIG. 4 unless two separate and distinct motions are applied to the switch. The latch, however, enables the rocker to be returned from the position of FIG. 4 with a simple single motion. Thus, the switch 20 is truly a safety switch in that separate motions are required for actuation so as to prevent accidental actuation of the switch and yet, at the same time, the switch may be quickly de-actuated under an emergency condition.

Figure 5:
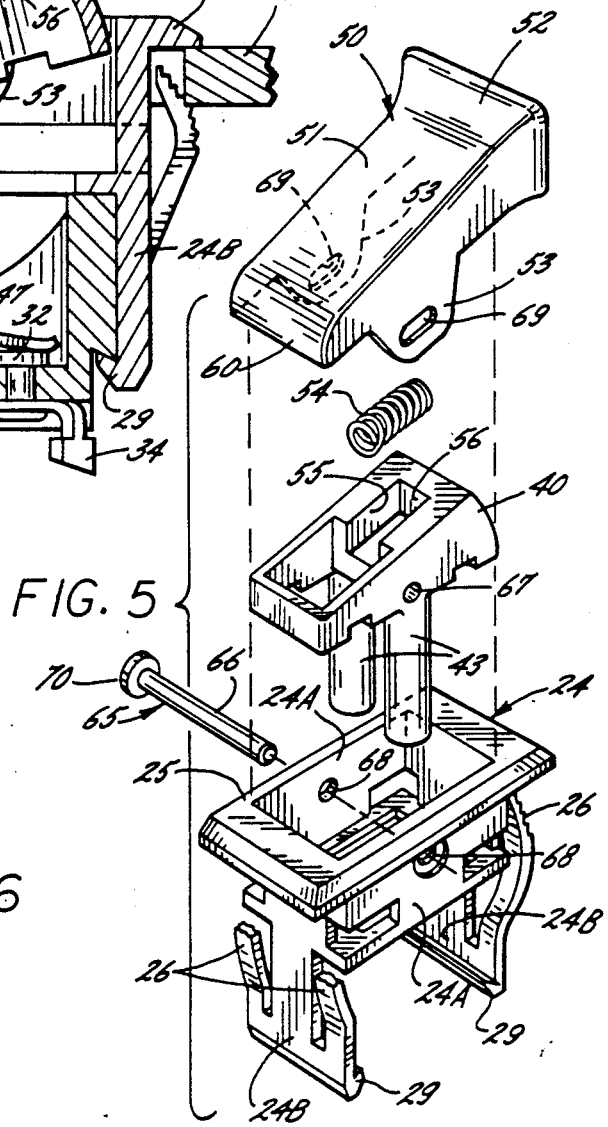
FIG. 5 is an exploded perspective view of certain components of the switch.

More specifically, the latch 50 includes an elongated plate 51 molded of plastic and formed with a somewhat enlarged gripping portion or handle 52 at one end. Formed integrally with and depending from the plate are two laterally spaced ears 53 (FIGS. 3 and 5) which straddle the rocker 40 and which fit into the sleeve 24 adjacent the side walls 24A thereof. The latch 50 is mounted for back and forth sliding on the rocker 40 between a latched position (FIG. 2) and an unlatched position (FIG. 4) and is urged toward its latched position. For this purpose, a coil spring 54 is retained in the stem portion of a T-shaped slot 55 (FIG. 5) in the rocker 40 and is compressed between a wall 56 of the slot and a lug 57 (FIG. 2) which extends downwardly from the lower side of the plate 51 of the latch 50. The lug fits in the cross portion of the T-slot 55.

As shown in FIG. 2, a nose 60 on the end of the latch plate 51 overlies the upper end of the sleeve 24 when the rocker 40 is in its normal position and the latch 50 is in its latched position. If the handle 52 of the latch is lifted while the latch is latched, the nose 60 engages the sleeve and prevents the rocker from pivoting counterclockwise through a sufficient distance to slide the contacts 37 across the center of the fulcrums 35. Accordingly, the latch prevents the rocker from being accidentally pivoted to its actuated position. By pulling on the handle 52 and sliding the latch 50 along the rocker 40, the nose 60 is retracted to a position clearing the upper end of the sleeve 24 and permitting the rocker to pivot counterclockwise through a distance sufficient to effect closing of the contacts 37 and 32. Thus, two distinct motions are required to pivot the rocker to its actuated position.

As the rocker 40 is pivoted to its actuated position (FIG. 4), the nose 60 of the latch 50 moves into the sleeve 24 and rides along the inner side thereof. When the latch 50 is released from between the thumb and forefinger, the spring 54 presses the nose 60 of the latch into frictional engagement with the inner side of the sleeve 24 to help hold the rocker 40 in a stable switch-actuated position.

To de-actuate the switch 20, it is necessary only to push or slam the handle 52 of the latch 50 downwardly in order to pivot the rocker 40 in a clockwise direction. As an incident thereto, the nose 60 of the latch rides upwardly out of the sleeve 24 and clears the sleeve so as to enable the spring 54 to return the latch to its latched position with the nose again overlying the upper end of the sleeve 24 and again limiting counterclockwise pivoting of the rocker. Thus, the switch may be de-actuated with a single motion and may be de-actuated rapidly in an emergency situation.

In accordance with the present invention, a rivet 65 (FIGS. 3 and 5) supports the rocker 40 to pivot within the sleeve 24 and also supports the latch 50 to pivot with and to slide relative to the rocker. The rivet is made of steel or other strong material and provides a high strength connection between the rocker 40 and the sleeve 24 and between the rocker and the latch 50.

More specifically, the rivet 65 includes an elongated shank 66 which extends through a hole 67 (FIG. 5) in the rocker 40 and through alined holes 68 in the side walls 24A of the sleeve 24. Thus, the rivet supports the rocker to pivot within the sleeve. The shank 66 of the rivet also extends through elongated slots 69 (FIG. 5) formed in the ears 53 of the latch 50. As a result, the rivet causes the latch to pivot with the rocker while supporting the latch to slide on the rocker between its latched and unlatched positions. The rivet is retained by an enlarged head 70 (FIG. 3) on one end of the shank and by a swaged portion 71 on the other end of the shank, the rivet being swaged after the shank has been inserted through the holes 67 and 68 and the slots 69. By virtue of the rivet, a high strength connection is established between the sleeve 24, the rocker 40 and the latch 50 in order to improve the durability of the switch 20.

I claim:

1. A safety switch comprising a hollow body having a pair of laterally spaced sides and having a switch contact, a switch actuator, means mounting said switch actuator within said body and between said sides for pivoting said actuator relative to said body between first and second switch contact positions, said means comprising aligned holes formed through said actuator and the sides of said body and further comprising a rivet extending through said holes, a latch having a pair of laterally spaced ears straddling said actuator and located within said body adjacent the sides thereof, elongated slots formed through said ears, said slots receiving said rivet and coacting with said rivet to mount said latch for pivotal movement with said actuator between said first and second positions and also to mount said latch for sliding movement relative to said actuator between latched and unlatched positions, said latch positively engaging said body when said latch is in said latched position and said actuator is in said first position and acting to prevent movement of said actuator to said second position, said latch releasing said body when said latch is moved to said unlatched position thereby to enable movement of said actuator to said second position, and means biasing said latch toward said latched position.

2. A safety switch as defined in claim 1 further including first and second spaced electrical contacts within said body, a fulcrum located in said body between said electrical contacts, said switch contact being pivoted in one direction about said fulcrum and engaging said first electrical contact when said actuator is in said first position, and said switch contact sliding across said fulcrum and pivoting in the other direction about said fulcrum to engage said second electrical contact when said actuator is pivoted from said first position to said second position.

3. A safety switch as defined in claim 2 further including a socket formed in said switch contact, said actuator including a spring-loaded plunger biased into said socket and pivotally received therein.

* * * * *